US011389860B2

(12) United States Patent
Ostino et al.

(10) Patent No.: US 11,389,860 B2
(45) Date of Patent: Jul. 19, 2022

(54) HOLLOW TURBINE BLADE WITH REDUCED COOLING AIR EXTRACTION

(71) Applicant: SAFRAN AIRCRAFT ENGINES, Paris (FR)

(72) Inventors: Leandre Ostino, Moissy-Cramayel (FR); Matthieu Simon, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 293 days.

(21) Appl. No.: 16/756,194

(22) PCT Filed: Oct. 11, 2018

(86) PCT No.: PCT/FR2018/052536
§ 371 (c)(1),
(2) Date: Apr. 15, 2020

(87) PCT Pub. No.: WO2019/077237
PCT Pub. Date: Apr. 25, 2019

(65) Prior Publication Data

US 2021/0187594 A1 Jun. 24, 2021

(30) Foreign Application Priority Data

Oct. 17, 2017 (FR) ..... 17 59722

(51) Int. Cl.
*F01D 5/18* (2006.01)
*B22C 9/10* (2006.01)
*F01D 5/20* (2006.01)

(52) U.S. Cl.
CPC ..... *B22C 9/10* (2013.01); *F01D 5/187* (2013.01); *F01D 5/20* (2013.01);
(Continued)

(58) Field of Classification Search
CPC ..... F01D 5/187; F01D 5/20; F05D 2240/307; F05D 2260/607; F05D 2230/211; B29C 9/10
See application file for complete search history.

(56) References Cited

U.S. PATENT DOCUMENTS 6,264,428 B1 7/2001 Dailey et al.
9,890,644 B2 * 2/2018 Tran ..... F01D 5/187
(Continued)

FOREIGN PATENT DOCUMENTS

CA 2 548 339 A1 12/2006
CN 104144757 A 11/2014
(Continued)

OTHER PUBLICATIONS

International Search Report dated Dec. 21, 2018 in PCT/FR2018/052536 filed on Oct. 11, 2018, 3 pages.
(Continued)

*Primary Examiner* — Eldon T Brockman
(74) *Attorney, Agent, or Firm* — Oblon, McClelland, Maier & Neustadt, L.L.P.

(57) ABSTRACT

A hollow turbomachine turbine blade including rising cavities communicating with a squealer tip of the blade through standard dust removal holes intended to remove dust and through inclined cooling bores intended to cool a barrier of the squealer tip by leading to a pressure side face of the blade, at least one rising cavity including a tip with no dust removal hole and an inclined cooling bore formed in its lateral wall and intended to cool the squealer tip barrier is enlarged to have a diameter at least equal to the standard diameter of a dust removal hole and thus also serve as a dust removal hole, so that the air flow extracted for cooling the blade is reduced, at least one of the cavities positioned facing the tip of one of the rising cavities having an
(Continued)

increased volume corresponding to at least a volume deducted from the tip of the rising cavity.

10 Claims, 3 Drawing Sheets

(52) U.S. Cl.
CPC .. *F05D 2230/211* (2013.01); *F05D 2240/307* (2013.01); *F05D 2260/202* (2013.01); *F05D 2260/607* (2013.01)

(56) References Cited

U.S. PATENT DOCUMENTS

| | | | | |
|---|---|---|---|---|
| 2003/0075300 | A1 | 4/2003 | Shah et al. | |
| 2004/0020629 | A1* | 2/2004 | Shah | B22D 29/002 164/369 |
| 2015/0132139 | A1 | 5/2015 | Tran et al. | |
| 2016/0341046 | A1* | 11/2016 | Feldmann | F01D 5/187 |
| 2017/0087630 | A1 | 3/2017 | Lee et al. | |
| 2018/0318919 | A1* | 11/2018 | Lee | B22D 25/02 |

FOREIGN PATENT DOCUMENTS

| | | | |
|---|---|---|---|
| CN | 106457363 | A | 2/2017 |
| EP | 1 022 432 | A2 | 7/2000 |
| EP | 1 882 817 | A3 | 5/2012 |
| FR | 2 986 982 | A1 | 8/2013 |
| RU | 1 625 078 | C | 5/1994 |

OTHER PUBLICATIONS

French Preliminary Search Report dated Jun. 5, 2018 in French Application 1759722 filed on Oct. 17, 2017.
Combined Chinese Office Action and Search Report dated May 28, 2021 in Chinese Patent Application No. 201880063947.3 (submitting English translation only), 5 pages.

* cited by examiner

HOLLOW TURBINE BLADE WITH REDUCED COOLING AIR EXTRACTION

FIELD OF THE INVENTION

The present invention relates to the general field of turbomachine blading, and more particularly to turbine hollow blades equipped with integral cooling circuits produced using the lost wax casting technique.

PRIOR ART

In a manner known per se, a turbomachine comprises a combustion chamber in which air and fuel are mixed before being burned there. The gases resulting from this combustion flow downstream from the combustion chamber and then feed a high-pressure turbine and a low-pressure turbine. Each turbine comprises one or more rows of fixed vanes (called nozzles) alternating with one or more rows of movable blades (called wheels), spaced circumferentially all around the rotor of the turbine. These turbine blades, whether fixed or movable, are subjected to the very high temperatures of the combustion gases, which reach values much greater than those which the blades in direct contact with these gases can endure without damage.

In order to resolve this problem, it is therefore known to equip these blades with internal cooling circuits having high levels of thermal effectiveness and intended to reduce the temperature of the latter by creating, inside the blade, an organized circulation of this air (for example by means of simple cavities with direct feeding or with trombones equipped with rising and falling cavities) and, in the wall of the blade, perforations intended to generate a protective film for this blade. The air flow used in these cooling circuits is extracted at the high-pressure compressor of the engine, so that this air extraction degrades the specific fuel consumption of the engine. It is therefore particularly attractive to minimize this flow of extracted air to improve the specific fuel consumption of the engine.

FIG. 4 illustrates schematically a portion of the core 10 of a high-pressure turbine blade of a gas turbine engine including an aerodynamic surface or airfoil 12 (in phantom form) which extends in a radial direction between a blade root (not shown) and a blade tip having a so-called squealer tip shape 18 consisting of a bottom 18A transverse to the airfoil and a wall (or barrier 18B) forming its edge in the continuation of the wall of the airfoil. The airfoil comprises a plurality of cavities of which, however, for the purpose of description, only four lateral cavities along the pressure side face of the blade and a so-called "sub-squealer tip" cavity positioned in large part below the bottom of the squealer tip 18A are illustrated by their respective portions of the core 22, 24, 26, 28, 30. The core also includes first ceramic rods 32-40 extending from the lateral walls (for example the lateral wall 24A of the core portion 24) of the core portions and intended to form inclined bores ensuring the cooling of the squealer tip barrier 18B on the pressure side face of the blade.

Taking into account the environment in which gas turbine engines operate, it is also necessary to provide the aforementioned cooling circuits with dust removal holes allowing the removal to the outside of the blade of particles or dust ingested by the engine and transported in the cooling air until the inlet of the different cavities. As a result of this function, the dust removal holes have a significantly greater diameter (with a ratio of approximately 2 to 5) than that of the inclined cooling bores. FIG. 3 shows four of these dust removal holes leading into the bottom of the squealer tip

18A and illustrated by respective second ceramic rods 42-48 extending vertically from the tip (for example the tip 24B of the core portion 24) of only the core portions 22, 24, 28, 30 forming rising cavities. In fact, the falling cavity 26 does not include a dust removal hole.

The presence of these dust removal holes is not inconsequential for the specific fuel consumption because the flow of cooling air removed by these holes is not used in the most effective manner possible for cooling the blade. However, it is impossible to eliminate them because then the risk of creating dust accumulation zone in the rising cavities becomes too high. And the presence of such dust accumulation zones is the source of hot points on the blade, tending to cause burns or accelerated local oxidation of the blade.

OBJECT AND SUMMARY OF THE INVENTION

The present invention is therefore intended to compensate for the aforementioned disadvantages by proposing a hollow turbine blade, the cooling air extraction of which is reduced to improve the specific fuel consumption of the engine.

To this end, a hollow turbomachine turbine blade is provided, including a plurality of rising cavities communicating, on the one hand, with a squealer tip of the blade through a plurality of dust removal holes with a standard diameter intended to remove dust, and on the other hand, through a plurality of inclined cooling bores intended to cool a barrier of said squealer tip by leading to a pressure side face of the blade, at least one rising cavity of which a tip has no dust removal hole, comprises an inclined cooling bore formed in its lateral wall and designed to cool said squealer tip barrier and the diameter of which is enlarged to have a diameter at least equal to said standard diameter of a dust removal hole and thus also serve as a dust removal hole, so that the air flow extracted for cooling the blade is reduced, the blade being characterized in that at least one of the cavities of the blade positioned facing said tip of said at least one rising cavity has an increased volume corresponding to at least a volume deducted from said tip of said at least one rising cavity.

By this configuration, which optimizes the shape and the positioning of a particular dust removal hole, it is possible to cool a movable high-pressure turbine blade with a smaller cooling flow but with the same thermal effectiveness as a conventional movable blade. The air flow removed by the dust removal holes is thus used for cooling, by film effect and pumping, the barrier of the pressure side squealer tip of the blade, which is in a zone subjected to the high air temperatures of the engine stream and therefore to high thermal stresses.

Depending on the embodiment considered, the inclined cooling bore thus enlarged, also serving as a dust removal hole, has an inclination oriented toward the squealer tip comprised between 45 and 75°.

Preferably, said tip of said at least one rising cavity has a concave shape, typically an inclined plane with an angle substantially equal to that of said inclined cooling bore or a stair-step allowing the flow to be oriented in the same direction as said inclined cooling bore.

Advantageously, said inclined cooling bore thus enlarged is positioned as close as possible to said tip of said at least one rising cavity until it is tangential to said tip.

The invention also relates to a ceramic core used for the manufacture of a hollow turbomachine turbine blade using the lost wax casting technique, the blade including a plurality of rising cavities communicating, on the one hand, with a squealer tip of the blade through a plurality of dust removal holes intended to remove dust and on the other hand through a plurality of inclined cooling bores intended to cool a barrier of said squealer tip by leading to a pressure side face of the blade, the core including:

- a plurality of core portions intended to form said plurality of rising cavities,
- a plurality of first ceramic rods of a first predetermined diameter extending from a lateral wall of said plurality of core portions and intended to form said plurality of cooling bores, and
- a plurality of second ceramic rods of a second predetermined diameter extending vertically from a tip of said plurality of core portions and intended to form said plurality of dust removal holes, said second predetermined diameter being greater than said first predetermined diameter, characterized in that a core portion intended to form a rising cavity of the blade does not have at its tip a second ceramic rod intended to form a dust removal hole and a first ceramic rod intended to form in its lateral wall an inclined cooling bore, also serving as a dust removal hole in order to ensure the cooling of said squealer tip barrier, has a first diameter at least equal to said second predetermined diameter, and in that said core portion has at its tip a volume deducted and at least one of the other core portions of said plurality of core portions positioned facing said tip of said core portion has an increased volume corresponding at least to said volume deducted from said tip of said at least one rising cavity.

Preferably, said volume deducted from the tip of said at least one rising cavity has a concave shape, typically an inclined plane or a stair-step the inclination of which corresponds to that of said first ceramic rod.

Advantageously, said increase of volume is a protruding portion centered on said core portion with a width and a height substantially equal to those of said inclined plane, without however extending beyond the tip of said core portion.

The invention also relates to the use of a ceramic rod of this type for the manufacture of a hollow turbomachine turbine blade using the lost wax casting technique and any turbomachine turbine equipped with several hollow turbine blades.

BRIEF DESCRIPTION OF THE DRAWINGS

Other features and advantages of the present invention will be revealed by the description given below, with reference to the appended drawings which illustrate an embodiment of it free of any limiting character and in which.

DETAILED DESCRIPTION OF AN EMBODIMENT

Figure 1:
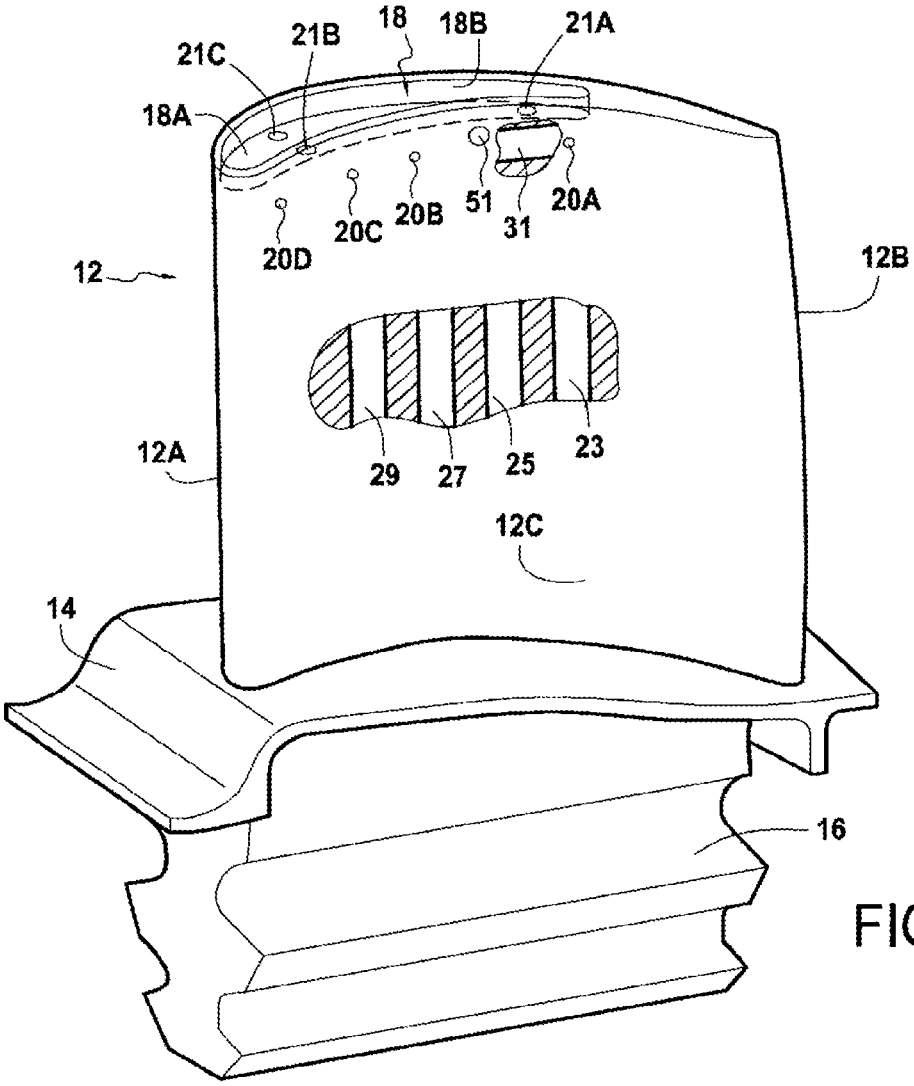
FIG. 1 is an external perspective view of a movable high-pressure turbine blade according to the invention.

FIG. 1 illustrates a hollow turbomachine high-pressure turbine blade conventionally extending radially relative to an axis of rotation of a movable wheel on which this hollow turbine blade is intended to be embedded with a plurality of others.

The blade comprises an airfoil 12 forming the aerodynamic surface of the blade, a platform 14 supporting this airfoil and a blade root 16 carrying the assembly and ensuring its embedding in the rotor of the turbine wheel (not shown). The airfoil 12 includes, as known, a leading edge 12A, a trailing edge 12B, a pressure side face 12C and a suction side face (face hidden in the figure). The squealer tip 18, consisting of the bottom 18A transverse to the airfoil and of the barrier 18B forming its edge in the continuation of the wall of the airfoil, is positioned at the tip of the blade (corresponding to the head end opposite to the blade root). The blade also includes perforations (bores on both faces or slots on the trailing edge) intended to generate a protective film of cooling air for this blade. The number and the position of the perforations are optimized to maximize cooling in the zones most sensitive to the heat of the combustion gases in which these blades are immersed and in particular for its pressure side face 12C which undergoes the strongest thermal stresses.

To avoid overloading the figure and ensure better comprehension of the invention, only the perforations relating to the invention have been shown, namely the inclined bores 20A to 20D ensuring the cooling of the squealer tip barrier 18B by leading to the pressure side face 12C of the blade, and the dust removal holes 21A to 21C allowing the removal of dust.

Figure 2A:
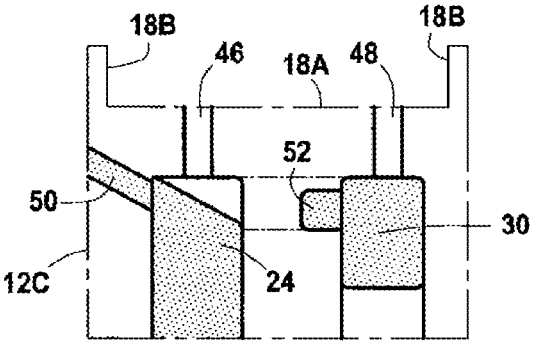
FIG. 2A is a section view at an inclined cooling and dust removal bore.
Figure 2:
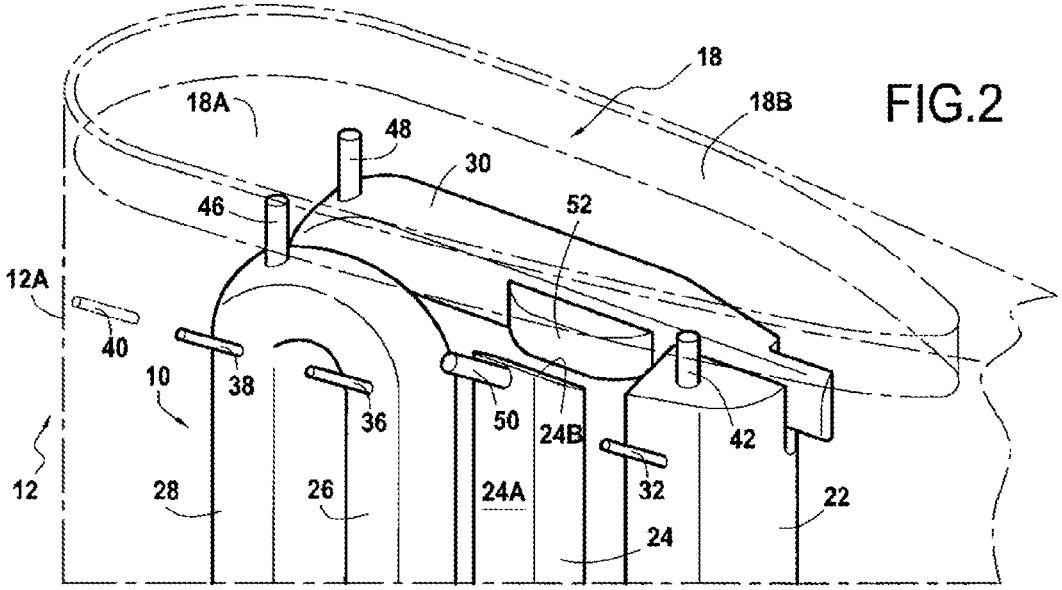
FIG. 2 is a schematic view of a first exemplary embodiment of a core portion of the turbine blade of FIG. 1.

FIG. 2 shows a portion of a ceramic core 10 intended for producing the movable blade of FIG. 1. This core shows in fact, in the example illustrated, that five core portions or columns can be rising or falling. The first rising column 22 is for example intended to form, once the blade is finished, a lateral cavity of the blade (labeled 23 in FIG. 1) receiving a first cooling air flow brought by a first duct while the other three adjoining columns forming a back-and-forth path on the pressure side face (with two rising columns 24, 28 and on, falling column 26 at the center) are intended to form lateral cavities of the blade (respectively labeled 25, 29 and 27 in FIG. 1) which can receive a second cooling air flow brought by another duct for example. The last core portion 30 is intended to form a so-called "sub-squealer tip" cavity (labeled 31 in FIG. 1) positioned in large part below the squealer tip bottom 18A.

The core also includes the first ceramic rods 32, 36, 38, 40 extending from a lateral wall (for example 24A) of the rising columns and intended to form the inclined bores ensuring the cooling of the squealer tip barrier 18B on the pressure side face of the blade and the second ceramic rods 42, 46, 48 extending vertically from the tip (for example 24B) of these rising columns and intended to form dust removal holes allowing the removal into the squealer tip of dust passing with the cooling air through the rising cavities 23, 29, 31 formed from these columns.

A multi-cavity ceramic core of this type naturally includes other core portions intended to form other cavities, not shown, such as a cavity situated in the portion of the blade near the leading edge 12A and one or more consecutive in-line cavities in the portion of the blade near the trailing edge 12B, all allowing the routing of the cooling air from the blade root 16 to the associated blade portions to be cooled. The ceramic rods, for their part, allow creating the inclined bores through which this air passes to reach the wall of the airfoil or to remove dust for those intended to form dust removal holes. The columns are separated from one another by predetermined spacing thus leaving space for the creation of a solid inter-cavity wall during the pouring of the melted metal.

In conformity with the invention, at least one of the rising cavities has no dust removal hole at its tip and the inclined cooling bore (with an inclination oriented toward the squealer tip on the order of 45 to) 75°, formed in its lateral wall near the tip of this cavity and normally intended to cool the squealer tip barrier by leading to the pressure side face of the blade, is enlarged by a ratio of 2 to 5 to also serve as a dust removal hole, such that the air flow extracted for cooling is thus reduced.

In a preferred embodiment of the invention illustrated in FIG. 2, the cavity without a dust removal hole is the rising cavity 25. However, the other rising cavities 23 and 29 can also have no dust removal holes insofar as these rising cavities are positioned next to the sub-squealer tip cavity 31 (for example, FIG. 3 with cavities 23 and 25).

In fact, the diameter of this cooling and dust removal bore 51 (corresponding to a ceramic rod 50) must be greater than the diameter of a standard cooling bore which, as previously indicated, is conventionally much smaller, in order to ensure, in addition to cooling, the proper removal of dust circulating in the internal cooling air. As illustrated, and to ensure effective dust removal, this bore is positioned as close as possible to the closed tip of the rising cavity, until it is effectively tangent to this tip, and can possibly be brought closer to the squealer tip barrier 18B. Preferably, the diameter of the inclined cooling and dust removal bore is selected at least equal to a standard dust removal hole.

Figure 4:
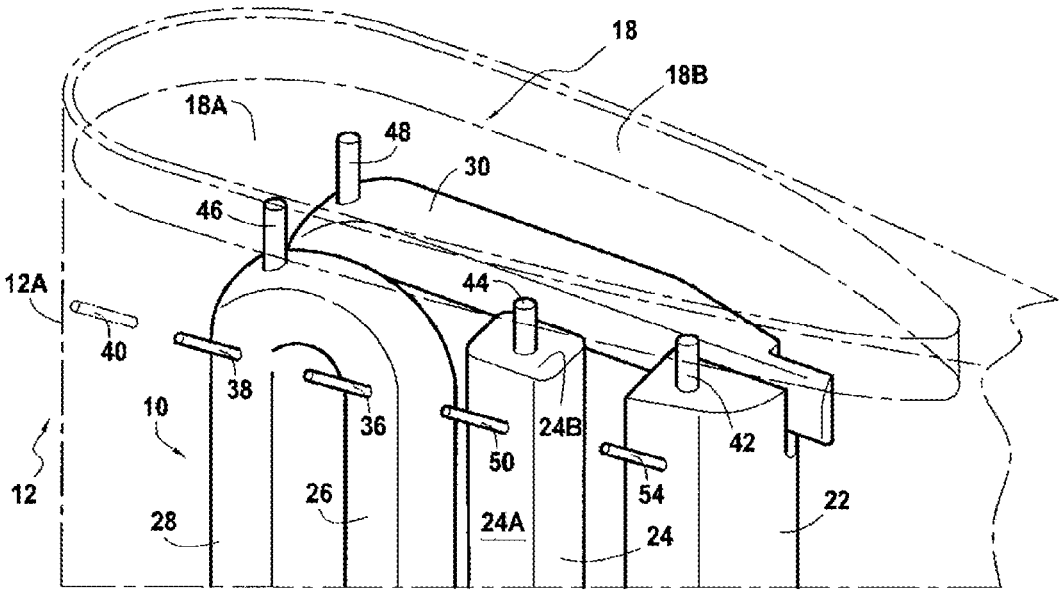
FIG.4 PRIOR ART
FIG. 4 is a schematic view of a core portion of a turbine blade of the prior art.

However, to correctly ensure dust removal from the cavity by means of this inclined bore, it is necessary to incline the tip of the rising cavity with an angle substantially identical with that of this inclined bore (i.e. within plus or minus 5°). The inclination of the tip of the rising cavity thus allows residual dust to be guided to the inclined bore and avoids the formation of particle accumulation zones at the tip of this cavity. In practice, this inclination of the tip of the rising cavity can assume any concave shape such as a stair-step, allowing the flow to be oriented in the same direction as the inclined bore. However, the creation of an inclined plane at the tip of the cavity by deducting a core volume causes a local increase in the corresponding quantity of matter at the top of the airfoil relative to a standard configuration as illustrated in FIG. 4, which is unfavorable to the mechanical strength of the blade because it tends to cause a creep phenomenon.

Therefore, in order not to degrade the mechanical lifetime of the blade, it is necessary to correct this increase in the quantity of matter due to the reduction of the upper portion of the column 24 by the addition of a core extension 52 positioned as closely as possible to the rising cavity with the inclined plane and generating an increase of the volume of the sub-squealer tip core portion 30 positioned facing the inclined plane formed at the tip 24A of the rising column 24.

As shown by FIGS. 2 and 2A, this increase in volume of the sub-squealer tip core portion 30 is substantially equal (i.e. to more or less 10%) to the volume resulting from the introduction of the inclined plane at the tip of the rising column 24 and is preferably a protruding portion centered on the rising column with a width and a height substantially equal to those of the inclined plane (i.e. to more or less 10%), the high level of this core extension 52 not exceeding that of this inclined plane, to ensure mechanical behavior similar to the initial conditions.

Figure 3:
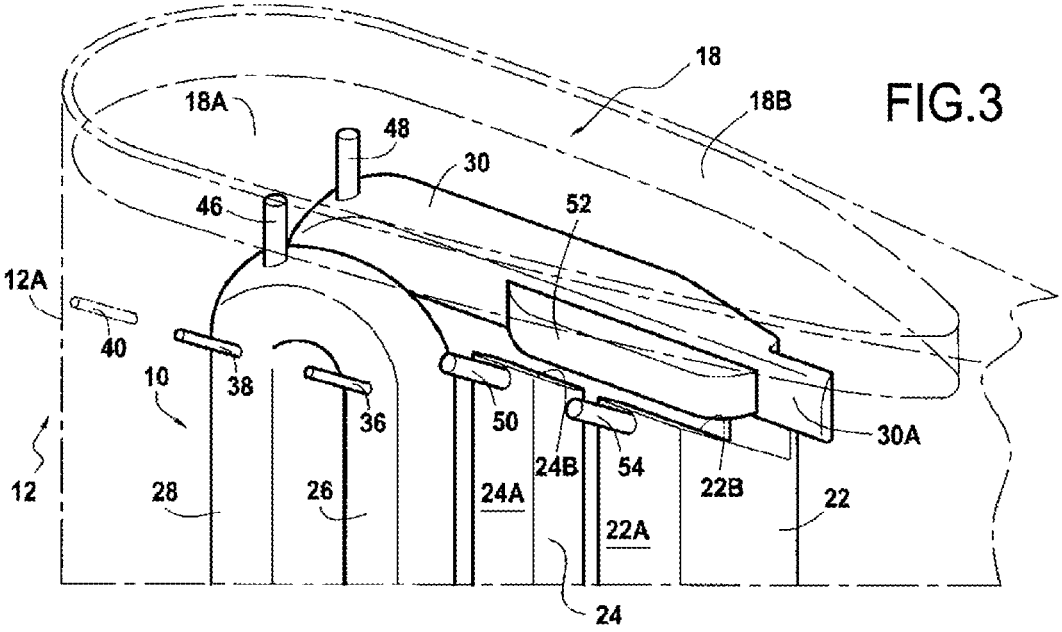
FIG. 3 is a schematic view of a second embodiment of a portion of the turbine blade core of FIG. 1.

FIG. 3 illustrates another embodiment of the invention in which not one but two rising cavities 23 and 25 are equipped with cooling and dust removal bores corresponding to ceramic rods 50 and 54 of columns 22 and 24. As in the preferred embodiment, these two bores are positioned as closely as possible to the tip of the two rising cavities. The diameter of these inclined cooling and dust removal bores is selected at least equal to the diameter of a standard dust removal hole to which they are substituted. Likewise, the tip of each of the two rising cavities 23, 35 has an angle substantially identical to that of the inclined bores, i.e. on the order of 45 to 75°. As before, it is necessary to correct the local increase in the quantity of matter due to the reduction of the upper part of the columns 22 and 24 by the addition of a core extension 52 positioned as closely as possible to these rising cavities with inclined planes, the volume of which is substantially equal to the volume resulting from the introduction of the two inclined planes at the tip of the rising columns 22 and 24. This core extension is preferably a protruding portion extending over the two rising columns with a height substantially equal to that of the inclined planes, the upper level of this core extension not exceeding that of these inclined planes.

With the invention, the conduction-convection heat transfer which occurs in the bore between the cooling air and the surrounding metal walls ensures cooling by pumping effect of the blade tip zone in general and of the pressure side squealer tip barrier in particular. The local reduction in air temperature in the stream and the increase of the heat exchange coefficient near the wall in the zones situated just downstream of the bores under the influence of cooling air emission by the bores ensure cooling by film effect, unlike a conventional dust removal hole where, taking into account the angle of emission of the cooling air relative to the wall of the blade, only the pumping effect contributes to the cooling of the blade tip zone.

It will be noted that the inclination of the cooling and dust removal holes must be sufficient (preferably greater than 45°) to take advantage of cooling by film effect without however being too great (preferably less than 75°) for reasons relating to manufacture by the lost wax casting technique.

The invention claimed is:

1. A hollow turbomachine turbine blade comprising a plurality of rising cavities communicating with a squealer tip of the blade through a plurality of dust removal holes with a diameter configured to remove dust, and through a plurality of inclined cooling bores configured to cool a barrier of said squealer tip by leading to a pressure side face of the blade, at least one rising cavity of which a tip has no dust removal hole, comprises an inclined cooling bore formed in its lateral wall and configured to cool said squealer tip barrier and the diameter of which is enlarged to have a diameter at least equal to said diameter of a dust removal hole and thus also serve as a dust removal hole, so that the air flow extracted for cooling the blade is reduced, wherein said tip of said at least one rising cavity is inclined with an angle substantially equal to that of said inclined cooling bore and the cavity facing said tip of said at least one rising cavity has an increased volume corresponding to at least a volume deducted from said tip of said at least one rising cavity.

2. The hollow turbine blade according to claim 1, wherein the inclined cooling bore thus enlarged, also serving as a dust removal hole, has an inclination oriented toward the squealer tip comprised between 45 and 75°.

3. The hollow turbine blade according to claim 1, wherein said tip of said at least one rising cavity has a concave shape, with an inclined plane with an angle substantially equal to that of said inclined cooling bore.

4. The hollow turbine blade according to claim 1, wherein said tip of said at least one rising cavity has a concave shape, with a stair-step, allowing the flow to be oriented in the same direction as said inclined cooling bore.

5. The hollow turbine blade according to claim 1, wherein said inclined cooling bore thus enlarged is positioned as close as possible to said tip of said at least one rising cavity until it is tangential to said tip.

6. A turbomachine including a plurality of hollow turbine blades according to claim 1.

7. A ceramic core used for the manufacture of a hollow turbomachine turbine blade using the lost wax casting technique, the blade including a plurality of rising cavities communicating with a squealer tip of the blade through a plurality of dust removal holes configured to remove dust and through a plurality of inclined cooling bores configured to cool a barrier of said squealer tip by leading to a pressure side face of the blade, the core including:

a plurality of core portions configured to form said plurality of rising cavities, a plurality of first ceramic rods of a first predetermined diameter extending from a lateral wall of said plurality of core portions and configured to form said plurality of cooling bores, and a plurality of second ceramic rods of a second predetermined diameter extending vertically from a tip of said plurality of core portions and configured to form said plurality of dust removal holes, said second predetermined diameter being greater than said first predetermined diameter, wherein a core portion configured to form a rising cavity of the blade does not have at its tip a second ceramic rod configured to form a dust removal hole and a first ceramic rod configured to form in its lateral wall an inclined cooling bore, also serving as a dust removal hole in order to ensure the cooling of said squealer tip barrier, has a first diameter at least equal to said second predetermined diameter, and wherein said core portion has at its tip a volume deducted and at least one of the other core portions of said plurality of core portions positioned facing said tip of said core portion has an increased volume corresponding at least to said volume deducted from said tip of said at least one rising cavity.

8. The ceramic core according to claim 7, wherein said volume deducted from the tip of said at least one rising cavity has a concave shape, with an inclined plane or a stair-step the inclination of which corresponds to that of said first ceramic rod.

9. The ceramic core according to claim 7, wherein said increase of volume is a protruding portion centered on said core portion having a width and a height substantially equal to those of said inclined plane, without however extending beyond the tip of said core portion.

10. The use of a ceramic core according to claim 7 for the manufacture of a hollow turbomachine turbine blade using the lost wax casting technique.

* * * * *